US005800255A

United States Patent [19]

Hyslop et al.

[11] Patent Number: 5,800,255

[45] Date of Patent: Sep. 1, 1998

[54] LAP ADAPTER

[75] Inventors: Ronald T. Hyslop, Tulsa; Lonny D. Qualls, Gore, both of Okla.

[73] Assignee: Coburn Optical Industries, Inc., Tulsa, Okla.

[21] Appl. No.: 759,291

[22] Filed: Dec. 2, 1996

Related U.S. Application Data

[63] Continuation of Ser. No. 341,349, Nov. 17, 1994, abandoned.

[51] Int. Cl.[6] ..... B24D 17/00

[52] U.S. Cl. ..... 451/550; 451/921; 451/905; 82/1.11; 82/165

[58] Field of Search ..... 451/550, 921, 451/905, 42

[56] References Cited

U.S. PATENT DOCUMENTS

| | | | |
|---|---|---|---|
| 1,471,351 | 10/1923 | Pellow | 451/42 X |
| 1,487,024 | 3/1924 | Robinson | 451/550 |
| 2,544,940 | 3/1951 | Ritterbusch et al. | 451/921 X |
| 2,749,685 | 6/1956 | Baldwin | 451/550 |
| 3,404,488 | 10/1968 | Cox et al. | 451/42 |
| 3,685,214 | 8/1972 | Sarofeen | 451/550 |
| 4,789,424 | 12/1988 | Fornadel et al. | 451/42 X |
| 4,979,337 | 12/1990 | Duppstadt | 451/550 |
| 5,157,880 | 10/1992 | Rotenberg et al. | 51/358 |
| 5,209,023 | 5/1993 | Bizer | 451/550 |
| 5,345,725 | 9/1994 | Anthony | 451/390 |

*Primary Examiner*—A. L. Pitts
*Assistant Examiner*—Henry W.H. Tsai
*Attorney, Agent, or Firm*—Frank J. Catalano; Scott P. Zingerman

[57] ABSTRACT

A unitary lap blank has a front polishing portion and a rear disk portion contoured for coupling the disk to a chuck of the lathe and also to a chuck of the polishing machine. Preferably, the disk has a circular channel in its face opposed to its base and a pair of seats in the opposed face symmetrically diametrically aligned in a land defined by the channel. The channel is of diameter, width and depth and the seats are spaced for mating with complementary components on the lathe chuck. The disk also has a circular seat centered in the land and a pair of parallel side walls disposed along symmetrically opposed cords of the disk transverse to a line connecting the pair of seats, the side walls being spaced apart by a distance and the seat being of diameter and depth for mating with complementary components on the polishing machine chuck.

3 Claims, 4 Drawing Sheets

LAP ADAPTER

This application is a continuation of application Ser. No. 08/341,349 filed on Nov. 17, 1994, now abandoned.

BACKGROUND OF THE INVENTION

This invention relates generally to equipment used in the making of ophthalmic lenses and more particularly concerns laps used for polishing surfaces of ophthalmic lenses.

In making an ophthalmic lens, a lens maker uses a lens generator to shape a lens blank selected for a desired prescription. The present assignee now markets a computerized lathe machine which cuts the lens blank to the desired configuration in response to data input to the computer defining the lens contour. After the lens has been generated, it is transferred to a fining/polishing machine to be polished. In the polishing step of the process, a permanent or reusable lap having a surface contoured to complement the surface of the lens being polished is covered with a suitable polishing material and orbited and oscillated against the lens surface. A unique lap is necessary for each prescription or lens contour. Therefore, the lens maker must keep an adequate inventory of laps suitable to the more common prescriptions. If a lens of less common prescription is to be polished, the lens maker often does not have the necessary unique lap in inventory. Consequently, that particular job will be turned over to a lens maker whose inventory of laps includes the lap required. One permanent lap is described in U.S. Pat. No. 5,157,880 issued to the present assignee on Oct. 27, 1992.

It is, therefore, an object of the present invention to provide a tool and method enabling a lens maker to polish a lens for which the lens maker has no lap stored in inventory. It is also an object of this invention to provide a tool and method enabling a lens maker to generate a lap suitable for polishing any lens the lens maker has made. Another object of this invention is to provide a tool and method enabling a lens maker to generate a temporary or single use unique lap from a lens blank. Another object of this invention is to provide a tool and method enabling a lens maker to generate a permanent unique lap from a permanent lens blank.

SUMMARY OF THE INVENTION

In accordance with the invention, a method and apparatus enable a lens maker to generate a unique lens polishing lap from a blank of material kept in the lens maker's inventory by use of a computerized lens making lathe having data input thereto defining the contour of a lens surface to be polished in a lens polishing machine. The lens maker first secures an adapter contoured to be coupled to a chuck of the lathe and to a chuck of the polishing machine to the blank. The adapter is then coupled to the lathe chuck and the computerized lathe operated in response to the data to generate a lap of contour complementary to the contour of the lens surface to be polished. The adapter is then uncoupled from the lathe chuck and coupled to the polishing machine chuck.

In one preferred embodiment, the adapter is a disk having a substantially flat base adhesively securable to a substantially flat base of the blank. Preferably, the disk has a circular channel in its face opposed to its base and a pair of seats in the opposed face symmetrically diametrically aligned in a land defined by the channel. The channel is of diameter, width and depth and the seats are spaced for mating with complementary components on the lathe chuck. The disk also has a circular seat centered in the land and a pair of parallel side walls disposed along symmetrically opposed cords of the disk transverse to a line connecting the pair of seats, the side walls being spaced apart by a distance and the seat being of diameter and depth for mating with complementary components on the polishing machine chuck.

In a preferred alternative embodiment, an adapter is used in conjunction with a lap blank having a front polishing portion and a rear rib structure already having a contour for coupling the blank to a chuck of the polishing machine. The adapter has an upper body portion contoured for coupling the adapter to a chuck of the lathe and a lower body portion contoured for coupling the adapter to the rear rib structure of the lap blank.

In another preferred alternative embodiment, a unitary lap blank has a front polishing portion and a rear disk portion contoured for coupling the disk to a chuck of the lathe and also to a chuck of the polishing machine.

BRIEF DESCRIPTION OF THE DRAWINGS

Other objects and advantages of the invention will become apparent upon reading the following detailed description and upon reference to the drawings in which.

DETAILED DESCRIPTION OF THE INVENTION

Figure 1:
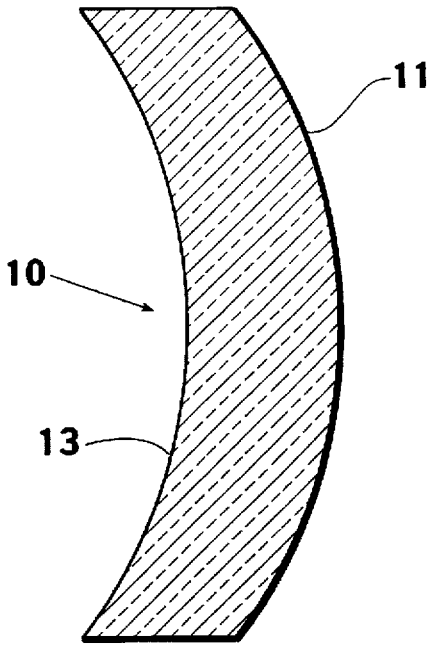
FIG. 1 is a sectional view of a lens having a unique rear surface contour for polishing.

Turning first to FIG. 1, a lens 10 cut by a computerized lens generator or lathe (not shown) has a convex front face 11 and a concave rear face 13. To polish the concave rear face 13 of the lens 10, a unique lap is required.

Figure 2:
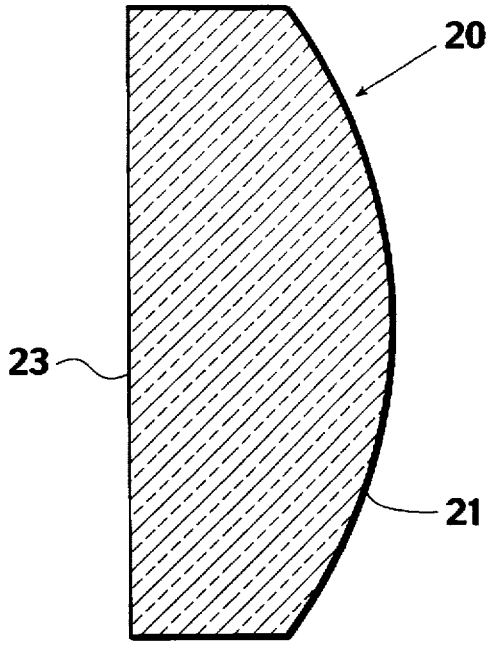
FIG. 2 is a sectional view of a typical lens blank used for making a lens.
Figure 3:
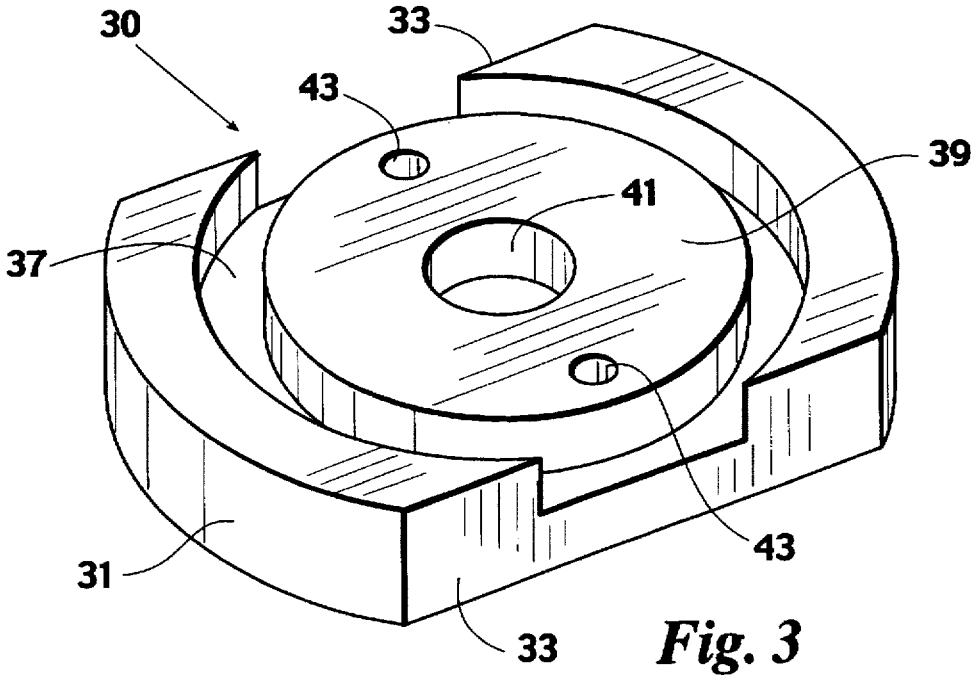
FIG. 3 is a perspective view of a preferred embodiment of an adapter to be applied to the lens blank of FIG. 2 to permit the lens maker to convert the lens blank into a unique lap.
Figure 4:
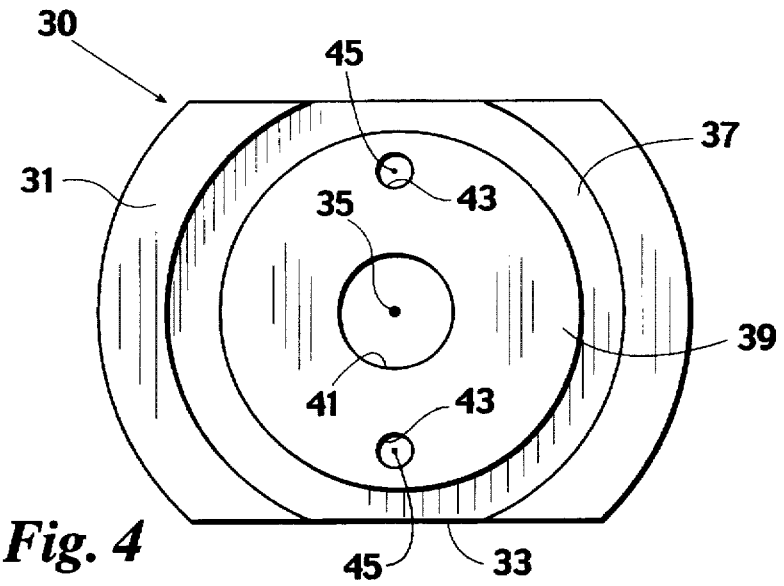
FIG. 4 is a top plan view of the adapter of FIG. 3.
Figure 6:
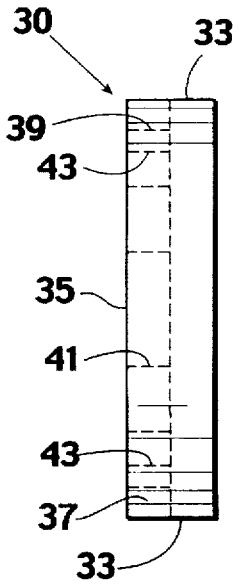
FIG. 6 is a front elevation view of the adapter of FIG. 3.
Figure 5:
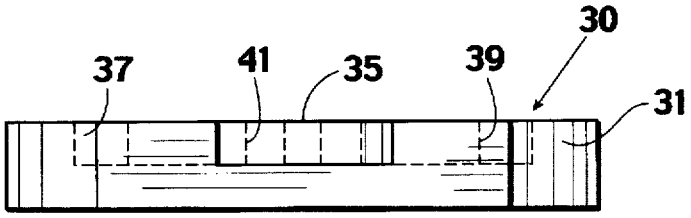
FIG. 5 is a side elevation view of the adapter of FIG. 3.

Turning now to FIG. 2, a typical lens blank 20 normally included in the inventory of a lens maker has a convex front face 21 and a substantially flat rear face 23. The convex front face 21 of the lens blank 20 is not a complementary contour to the concave rear face 13 of the lens 10 which is to be polished.

Figure 7:
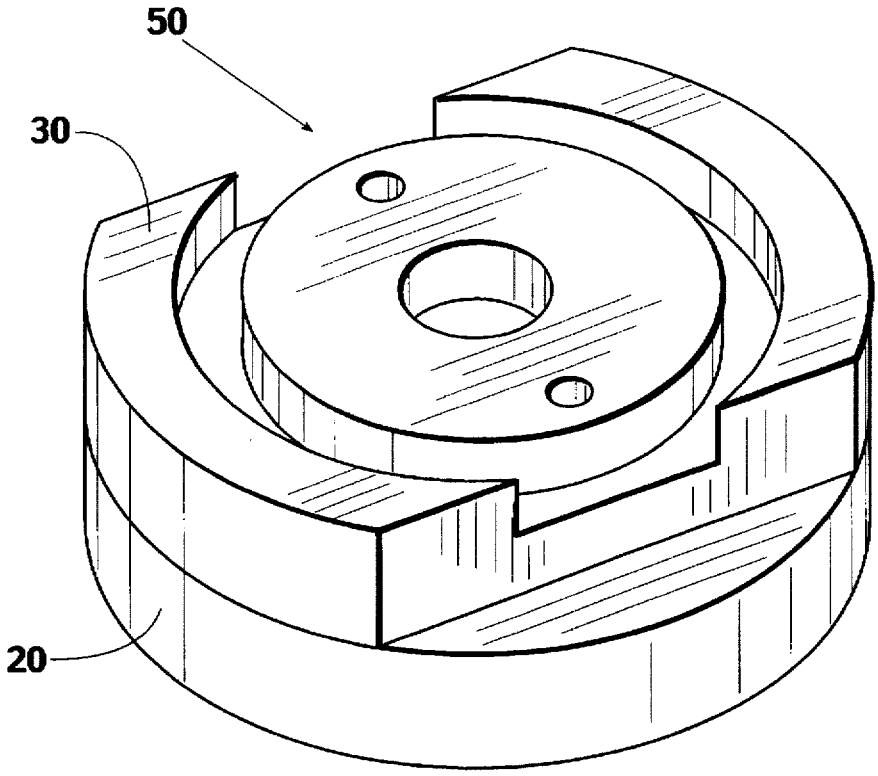
FIG. 7 is a perspective view of the adapter of FIG. 3 secured to the lens block of FIG. 2 to provide a lap blank for generating a unique lap.
Figure 8:
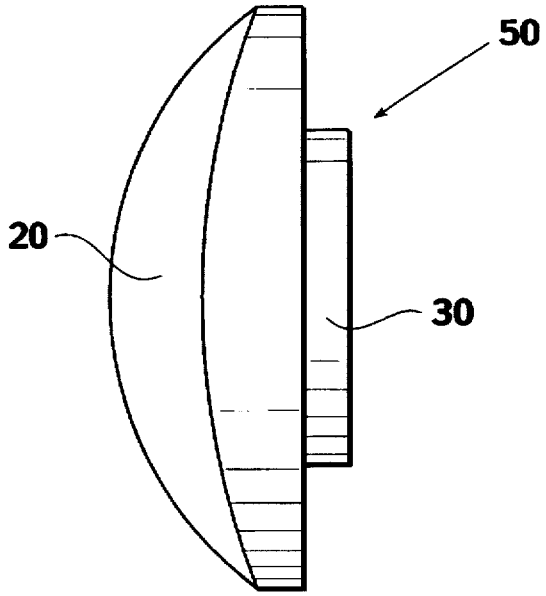
FIG. 8 is a side elevation view of the lap blank of FIG. 7.
Figure 10:
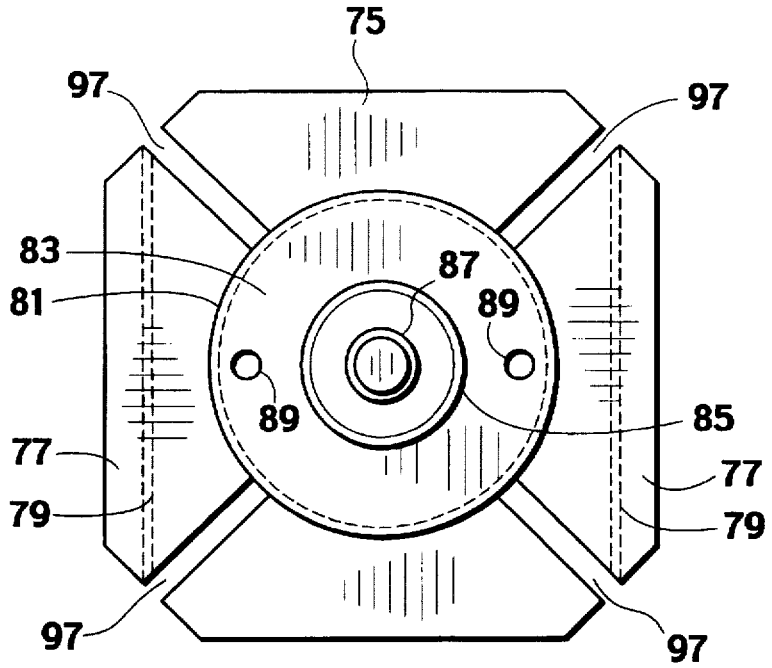
FIG. 10 is a top plan view of the adapter of FIG. 9.

In FIGS. 3 through 6, an adapter 30 usable to enable the lens maker to convert the lens blank 20 into a suitable lap is illustrated. The adapter consists of a substantially circular disk 31 having parallel side walls definable as cords 33 symmetrically displaced from the center 35 of the disk 31. A concentric channel 37 is provided in the top face of the disk 31 which defines a complete circular land 39 but which overlaps the cords 33. The land is provided with a concentric sink 41 at the center 35 of the disk 31 and with a pair of circular seats diametrically symmetrically located on centers 45 defining a line transverse to the cords 33. The channel 37 is of inner and outer diameter and depth and the seats 43 of diameter and depth such as to be engagable with a typical chuck used in a lens generator. The cords 33 are spaced apart by a distance and the sink 41 of diameter and depth so as to be engagable with a typical chuck used in a lens polisher. The outer diameter of the disk 31 is substantially the same as the outer diameter of a typical lens blank 20 such as is illustrated in FIG. 2. Consequently, the adapter 30 can, by use of a suitable adhesive, be secured to the flat rear face 23 of the lens blank 20 so as to provide a lap blank 50 as illustrated in FIGS. 7 and 8. The lap blank 50 can then be mounted on the chuck of the lens generator and the data defining the unique concave rear face 13 of the lens 10 used to cause the lens generator to generate a complementary unique surface on the lap blank 50. The generated unique lap can then be transferred from the chuck of the lens generator to the chuck of the lens polisher using the same adapter 30 and, with the appropriate polishing material placed over the unique lap, the concave rear face 13 of the lens 10 can be polished.

Figure 9:
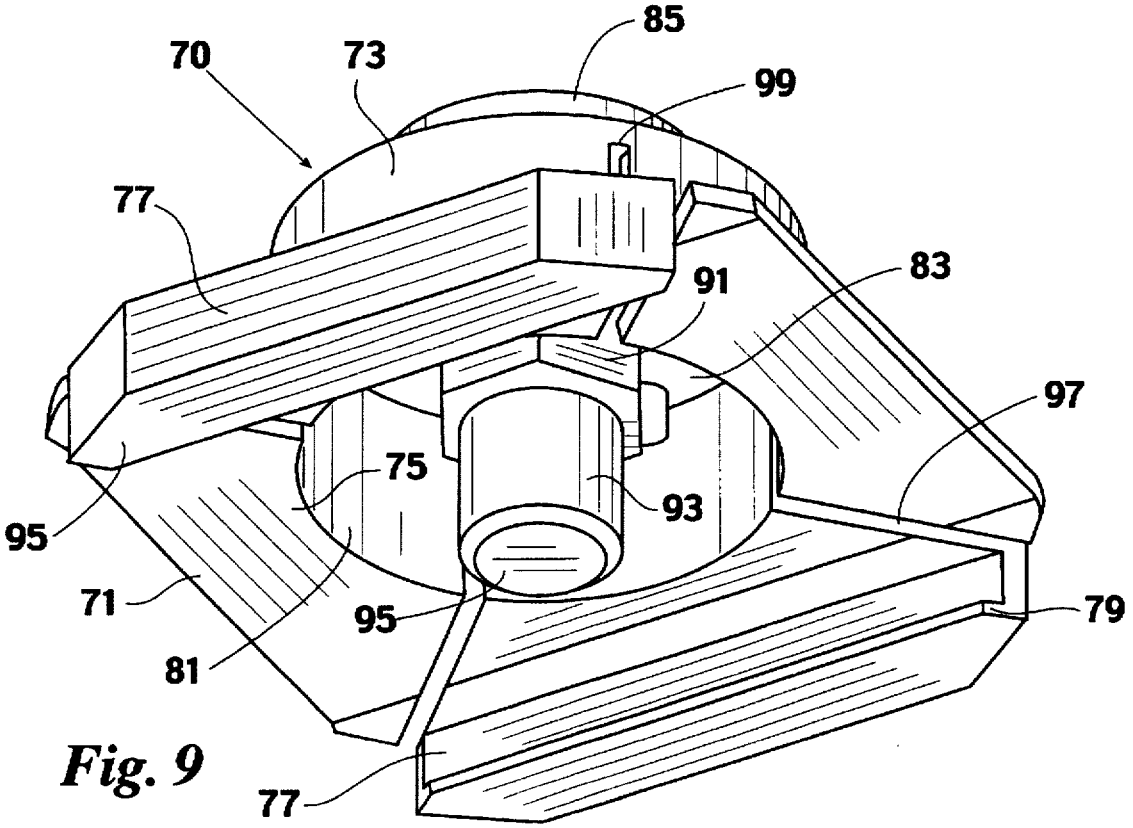
FIG. 9 is a perspective view of a preferred embodiment of an alternate adapter to be applied to the lap of FIG. 7 to enable a lens maker to generate a unique lap.

An alternate adapter is illustrated in FIG. 9 which will adapt a lap of U.S. Pat. No. 5,157,880 so that a unique lap can be generated from standard lap to which the adapter 70 is attached. As shown, the adapter 70 consists of a substantially hollow metal body defining a substantially rectangular lower portion 71 and a circular upper portion 73. The lower rectangular portion 71 is adapted for mounting on the skeletal rib structure on the rear of a typical lap such as is illustrated in U.S. Pat. No. 5,157,880. The upper circular portion 73 is adapted for mounting on the chuck of a lathe. To this end, the lower rectangular portion 71 has a horizontal top wall 75 with downwardly depending flanges 77 defining opposing side walls along the length of the rectangular portion 71. A rib 79 is provided along the lower interior edge of each flange and the distance between the interior edges of the ribs 79 is such that the lower rectangular portion 71 will snugly engage the rib structure on the rear of the lap. The circular upper portion 73 consists of a cylindrical vertical wall 81 with a horizontal cap 83 and a concentric circular land 85 extending upwardly from the cap 83. A concentric channel 87 is provided in the land 85 and two diametrically opposed apertures 89 extend through the cap 83 equidistant from the center of the cap 83 and along a line transverse to the downwardly depending flanges 77. A hex nut 91 affixed to the underside of the cap 83 supports a downwardly depending shaft 93 which extends to the bottom plane 95 of the adapter 70. Four slots 97 divide the adapter 70 into quadrants extending from the bottom plane 95 of the adapter to a plane 99 extending approximately midway across the cylindrical vertical wall 81 of the upper circular portion 73.

To generate a unique lap from a typical lap as shown in U.S. Pat. No. 5,157,880, the adapter 70 is attached to the skeletal structure of the typical lap by aligning the shaft 93 with the central aperture of the lap and pressing the adapter 70 toward the lap to engage the side walls of the lap's skeletal structure. Thus, the ribbed flanges 77 grip the lap to prevent its motion in a first direction relative to the adapter 70 and the shaft 93 engages within the aperture of the lap to prevent relative movement of the adapter 70 in relation to the lap in a second direction transverse to the first direction. Once the surface of the lap has been cut to its unique contour in the lap generator, the adapter 70 can be removed and the unique lap mounted in the normal fashion in the lens polisher for the polishing step of the process.

Figure 11:
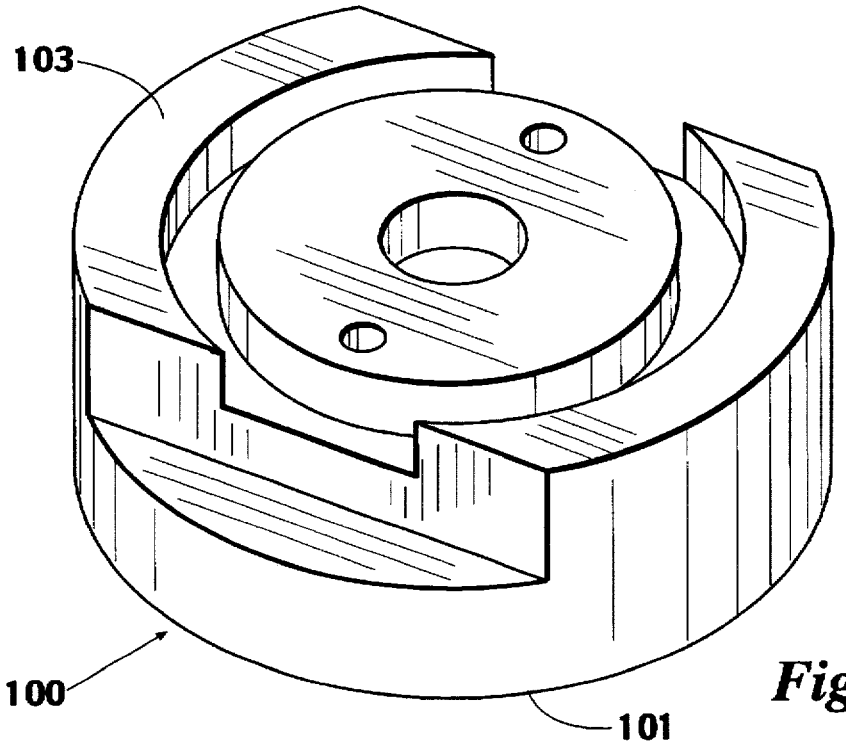
FIG. 11 is a perspective view of a preferred embodiment of a unitary lap blank which can be used by a lens maker to generate a unique lap.

As another alternative, looking at FIG. 11, a unitary lap 100 can be molded having a front lap portion 101 similar in all respects to that of the typical lap shown in U.S. Pat. No. 5,157,880 and having a rear portion 103 identical in all respects to the adapter 30 illustrated in FIGS. 3 through 6 herein. The lens maker can thus keep a small inventory of typical lap blanks for generation into unique laps as required.

Thus, it is apparent that there has been provided, in accordance with the invention, a lens adapter that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For use in generating a unique lens polishing lap by use of a computerized lens making lathe having data input thereto defining a contour of a lens surface to be polished in a lens polishing machine, a lap blank comprising a front lap portion and a rear disk portion having upper and lower parallel faces, said disk portion having first means thereon for coupling said disk portion to a chuck of the lathe and second means thereon for coupling said disk portion to a chuck of the polishing machine, said first means comprising an annular channel in said upper face of said disk portion defining a circular land within said channel and a pair of seats in said land, said channel and said seats being arranged for mating with complementary components on the lathe chuck.

2. A lap blank according to claim 1, said second coupling means comprising a circular seat extending from said upper face of said disk portion into said land and a pair of parallel side walls on said disk portion disposed along symmetrically opposed cords of said disk portion, said side walls being spaced apart by a distance and said circular seat being of diameter and location between said side walls for mating with complementary components on the polishing machine chuck.

3. For use in generating a unique lens polishing lap by use of a computerized lens making lathe having data input thereto defining a contour of a lens surface to be polished in a lens polishing machine, a lap blank comprising a front lap portion and a rear disk portion having upper and lower parallel faces, said disk portion having first means thereon for coupling said disk portion to a chuck of the lathe and second means thereon for coupling said disk portion to a chuck of the polishing machine, said first means comprising an annular channel in said upper face of said disk portion defining a circular land within said channel and a pair of seats in said land symmetrically diametrically aligned in said land, said channel being of diameter, width and depth and said seats being spaced for mating with complementary components on the lathe chuck, and said second coupling means comprising a circular seat centered in and extending from said upper face of said disk portion into said land and concentric with said annular channel and a pair of parallel side walls on said disk portion disposed along symmetrically opposed cords of said disk portion transverse to a line connecting said pair of seats, said side walls being spaced apart by a distance and said circular seat being of diameter and depth for mating with complementary components on the polishing machine chuck.

* * * * *

UNITED STATES PATENT AND TRADEMARK OFFICE

Certificate

Patent No. 5,800,255 Patented: September 1, 1998

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Lonnie D. Qualls.

Signed and Sealed this Tenth Day of August, 1999.

ANDREA L. PITTS
*Supervisory Patent Examiner*
Art Unit 3722